US005604408A

United States Patent [19]

Hamm

[11] Patent Number: 5,604,408

[45] Date of Patent: Feb. 18, 1997

[54] CONTROL DEVICE FOR A FLUORESCENT TUBE, HAVING SYNCHRONIZED BLOCKING OF AUXILIARY AND PRIMARY TRANSISTORS

[76] Inventor: Valery Hamm, Les Pelouses Route du Lude, 72200 La Fleche, France

[21] Appl. No.: 418,115

[22] Filed: Apr. 6, 1995

[30] Foreign Application Priority Data

Apr. 6, 1994 [FR] France ..... 94 04046

[51] Int. Cl.[6] ..... H05B 37/02

[52] U.S. Cl. ..... 315/94; 315/307; 315/DIG. 7

[58] Field of Search ..... 315/94, 107, 105, 315/106, 101, 102, 291, 307, 308, DIG. 7

[56] References Cited

U.S. PATENT DOCUMENTS 4,368,409 1/1983 Sivanesan et al. ..... 315/411

FOREIGN PATENT DOCUMENTS 0519220 12/1992 European Pat. Off. .
3538533 5/1987 Germany .
4005776 9/1990 Germany .

*Primary Examiner*—Robert Pascal
*Assistant Examiner*—David H. Vu
*Attorney, Agent, or Firm*—Young & Thompson

[57] ABSTRACT

In a device to control a fluorescent tube supplied from a DC source by an accumulating converter, a rectifying bridge 17 is mounted opposite to the secondary 13, between the preheating electrodes 2, 3 of the tube, and supplies an auxiliary transistor 16. An energizing synchronizer 14 supplied by the rectifying bridge 17 receives at one input 24 the control signal of the primary transistor 5 from the modulator 4, and controls the blocking of the auxiliary transistor 16 in synchronism with the blocking of the primary transistor 5.

9 Claims, 2 Drawing Sheets

CONTROL DEVICE FOR A FLUORESCENT TUBE, HAVING SYNCHRONIZED BLOCKING OF AUXILIARY AND PRIMARY TRANSISTORS

BACKGROUND OF THE INVENTION

1. Filed of the Invention

The invention relates to a control device for a fluorescent tube supplied from a DC voltage source.

2Description of the Related Art

Lighting of dwellings as well as common or industrial areas uses many fluorescent tubes supplied from an alternating electrical public distribution network of 220V/50 Hz. The specific characteristics of fluorescent tubes require in each lamp the presence of an igniter to start the electrical discharge through the tube and of a ballast to set the intensity of the current in spite of the zone of negative resistance of the voltage/current curve of the tube.

For the control of fluorescent tubes, electronic circuits have been implemented to replace the igniter and the ballast by static semiconductor devices. These circuits are usually resonant converters or accumulating converters.

The proposed devices are in general based on the use of a resonant converter such as the one described in the article: "The electronic control of fluorescent tubes—Michaä ël BAIRANZADE—Electronique de puissance No 30". This electroni well adapted to the 220 V/50 Hz local supply area but is not well adapted to function from a low voltage DC source, such as a 12 volt battery. The presence of two power transistors in series in this case leads to energy outputs that are too low, incompatible with a duration between rechargings that would be acceptable by the user. On the other hand, the structure of the accumulating converter is unsuited for use in the local supply area because of the too high voltage imposed on the power transistor. It is perfectly suited, however, for a use at low DC voltage, in a battery. The article: "Un luminaire solaire autonome —Christophe BASSO —Radio Plans No 529" describes the basic principle of such an implementation.

SUMMARY OF THE INVENTION

The device according to the invention also uses an accumulating converter structure known to a person skilled in the art, by bringing to it the necessary improvements to obtain a rapid and certain energizing of the fluorescent tube in all circumstances, including at low temperature, and to protect the electronic circuits against the over-voltages generated in the case of withdrawal of the tube from its support, or in case of defective energizing.

The object of the invention is a device for controlling a fluorescent tube, supplied from a DC source via an accumulating converter comprising a transformer, whose primary is in series with the primary transistor, controlled by a pulse magnitude modulator, and a means of measuring the current, and whose secondary connects to the fluorescent tube, characterized in that it comprises:

- a rectifying bridge, mounted opposite from the secondary, between the tube preheating electrodes;
- an auxiliary transistor supplied by the rectifying bridge, and
- an energizing synchronizer connecting to the rectifying bridge, receiving at an input the primary transistor control signal by the modulator, and controlling the auxiliary transistor by an output, in such a manner that the blockage of the auxiliary transistor is controlled by the energizing synchronizer in synchronism with the blocking of the primary transistor by the modulator.

According to other characteristics of the invention:

- the synchronizer comprises an electronic latch, one input of which is controlled by an integrator of the output voltage of the rectifying bridge, and another input of which is controlled by a derivator of the blocking signal of the primary transistor from the modulator, in such a manner as to control by the integrator the preheating time of the tube, and to control by the derivator the change of state of the latch and the blockage of the auxiliary transistor;
- the device comprises, moreover, a voltage divider supplied by the voltage at the terminal of the measuring means, receiving from the synchronizer the control signal of the auxiliary transistor, and applying to the modulator a low voltage signal during a conduction time of the auxiliary transistor corresponding to the preheating time of the tube, and a high voltage signal when the auxiliary transistor is blocked;
- the voltage divider is constituted by a first resistance in series with two resistance in parallel one of which is in series with the transistor controlled by the auxiliary transistor control signal in such a manner that, when the transistor conducts, the mid-point of the voltage divider delivers a low voltage and when the transistor is blocked, the mid-point of the voltage divider delivers a high voltage;
- the device comprises, moreover, a protection circuit supplied by the voltage at the common point of the primary transistor and the primary of the transformer, and delivering to the modulator an inhibition signal in such a manner as to block the modulator during a predetermined time in case of tube malfunction;
- the protection circuit comprises a capacitor susceptible to a progressive charging at each blockage of the primary transistor until it reaches a inhibition threshold of the modulator and discharges slowly in a resistance until it reaches the disinhibition threshold of the modulator;
- the protection circuit comprises a rectifier and a second capacitor, whose mid-point is connected to the capacitor by a diode and a resistance in such a manner as to ensure the progressive charging of said capacitor while keeping it from discharging across the rectifier;
- apart from the tube and the transformer, the control device assembly is implemented in hybrid technology;
- apart from the tube and the transformer, the control device assembly is implemented in the form of an electronic integrated circuit.

BRIEF DESCRIPTION OF THE DRAWINGS

Other characteristics emerge from the following description in reference to the attached drawings in which.

DETAILED DESCRIPTION OF THE PREFERRED EMBODIMENT

Figure 1:
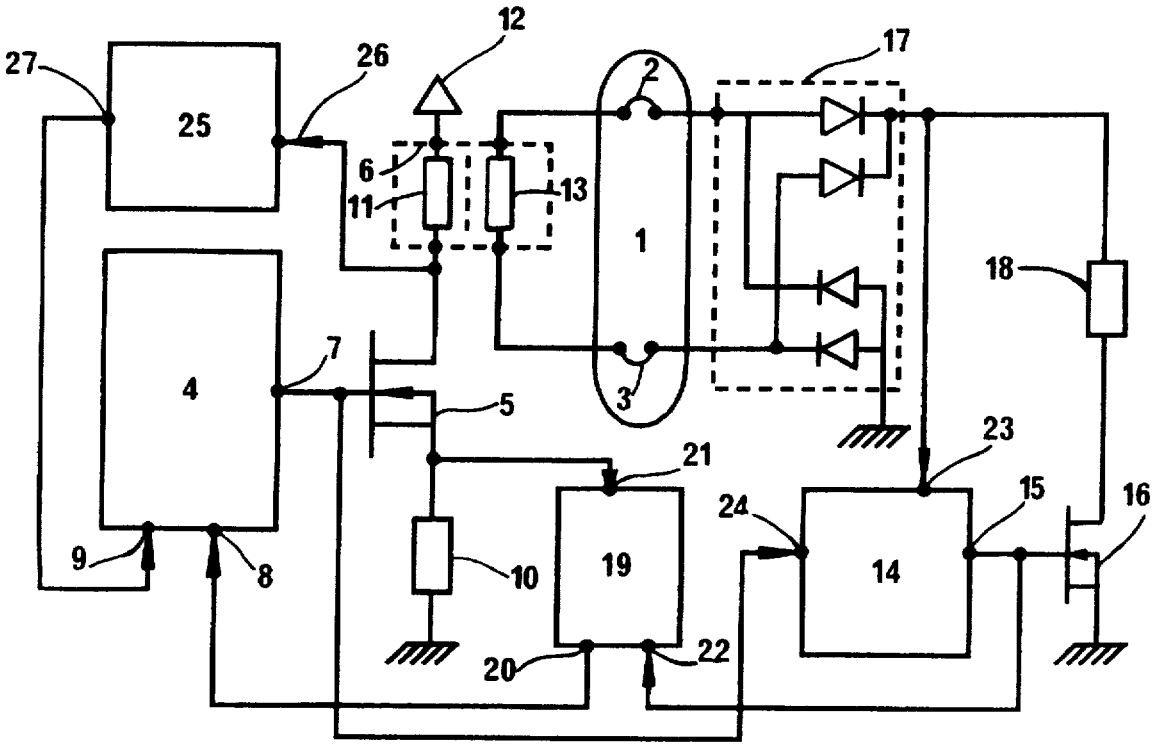
FIG. 1 represents a simplified schematic of a control device of a fluorescent tube according the invention.

FIG. 1 represents in a schematic manner the energizing and supply device of a fluorescent tube 1 equipped in known fashion with two preheating electrodes 2 and 3. The accumulating converter, known to one of skill in the art, is constituted by a pulse magnitude modulator 4 of a primary commutation transistor 5 and high frequency transformer 6. The modulator 4 controls, at a cutoff frequency of several KHz in general, from an input 7, the blocked or saturated state of the primary transistor 5. The modulator 4 comprises at least a current limiting input 8 and at least an inhibition input 9. The primary transistor 5 is connected, on the one hand, to a current measuring means 10 and on the other hand to an extremity of the primary 11 of the transformer 6. The other extremity of the primary 11 is connected to the DC supply source 12, in general a battery of 12 or 24 volts, but which could also be, among others, a cell or a solar panel, without changing the nature of the invention. The current measuring means 10 is in general a resistance, but could also be, among others, a current transformer, a hall effect probe, without changing the nature of the invention. The primary transistor 5 when it is rendered conductive by the output 7 of the modulator 4, allows the passage of a current through the primary 11 and applies to the terminals of this primary 11 the voltage of the DC source 12. At the same time, because of the transformer 6, a voltage appears at the terminals of the secondary 13. Following the energizing state of the tube 1 and the state of the other element of the circuit, a current can circulate in 13. When the primary transistor 5 is blocked by the action of the output 7 the current disappears in 11. The voltage at the terminals of 13 inverts. Following the energizing state of the tube 1 and the state of other elements in the circuit, a current can circulate in 13 and a voltage of great or small magnitude is established at the terminals of 11 and 13.

Upon being applied with voltage, an energizing synchronizer 14, from its output 15, renders conductive the auxiliary transistor 16. The rectifying bridge 17, from the AC voltage existing at the terminals of the secondary 13 and the preheating electrodes 2 and 3, makes a current circulate through these electrodes whose amplitude is fixed by a resistance 18, which heats the electrodes 2 and 3, thus the gas contained in the tube 1, to obtain a correct and rapid energizing of the tube 1 in all circumstances. This current must be greater than the nominal current of the tube 1. During the conduction of the auxiliary transistor 16, a control voltage divider 19 applies, from its output 20, on the current limiting input 8 of the modulator 4, a predetermined portion of the voltage to the terminals of the measuring means 10 which it receives at its input 21. When the voltage at the terminal 8 reaches the limiting threshold, the modulator 4 blocks the primary transistor 5 from its output 7 which has the effect of limiting the maximum value of the current running through the transistor 5, the measuring means 10 and the primary 11. When the auxiliary transistor 16 is blocked and when the tube 1 is energized, the controlled divider 19 reacts to the control of the auxiliary transistor 16, issued from the output 15 of energizing synchronizer 14, which it receives at its input 21 by applying, by its output 20, on the limiting input 8 the quasi-totality of the voltage at the terminals of the measuring means 10. The current running through the transistor 5, the measuring means, and the primary 11 is then limited to its nominal value. The action of the control divider 19 translates then into a preheating current in the tube 1, greater than the nominal current.

The duration of the preheating, and thus of the duration of conduction of the auxiliary transistor 16, depends upon the characteristics of the tube 1 but is for all intents and purposes limited in time. The synchronizer 14 receives respectively on its inputs 23 and 24 the output voltage of the rectifying bridge 17 and the control signal of the primary transistor 5 from the output 7 of the modulator 4. The synchronizer 14 integrates the input voltage at its input 23. When the value of the integration reaches a predetermined threshold, the synchronizer 14 blocks the secondary transistor 16, by action of its output 15, in synchronism with the signal received on the input 24, thus in synchronism with the blocking of the primary transistor 5. The over-voltage obtained at the secondary 13 is then maximal, because at the instant of the blockage of the transistor 5, meaning at the interruption of the current in the transistor 5, thus in the energy transfer between the primary 11 and the secondary 13, the current cannot establish itself in the secondary 13 because the tube 1 is not yet energized and because the auxiliary 16 has just been blocked. If one chooses an auxiliary transistor 16 running at a voltage greater than the energizing voltage of the tube 1, the maximum over-voltage obtained at the terminals of the secondary 13 then energizes in a certain and efficacious manner the tube 1 which lights up.

The over-voltage at the terminals of the secondary 13, by the effect of the transformer 6 appears as well, depending on the number of windings of the primary 11 and the secondary 13, at the terminals of the primary 11. If the tube 1 is absent or is defective, refusing to energize, the over-voltage can become destructive for the transistors 5 and 16, which is unacceptable. A protection circuit 25 receives at its input 26 the voltage appearing at the transistor 5 and peak-rectifies to a level authorizing the energizing of the tube 1, by preventing the destruction of the transistors 5 and 16. The protection circuit 25 acts upon each blockage of the primary transistor 5, at the functioning frequency of the modulator 4. If at the end of a few periods the peak rectifying action continues, this clearly signifies that the tube 1 is absent or refuses to energize, thus is defective. It is not necessary that the modulator 4 continues to function by needlessly absorbing the energy at the DC source 12, avail. If the source 12 is a battery, the duration between charges will be increased. If it is a cell, its useful life will be increased. At the end of a few periods, the protection circuit 25 by the intermediary of its output 27 acts on the inhibition input 9, which stops the functioning of the modulator 4 and thus makes the over-voltage at the terminals of the primary disappear. After a predetermined time, well before the cutoff period of the modulator 4, but imperceptible to the eye, the protection circuit 25 by its output 27 acting on the inhibition input 9, frees the modulator 4. If the tube 1 is always absent or is defective, the same process is carried out again. If the user has installed the tube 1, the normal energizing cycle is carried out.

The exact physical nature of the primary transistor 5 and of the auxiliary transistor 16 is of no importance with respect to the invention.

They may, for example, be bipolar transistors, power field effect transistors (MOS), bipolar insulated-gate transistors (IGBT), field effect transistor control thyristors (MCT), without changing the nature of the invention.

Figure 2:
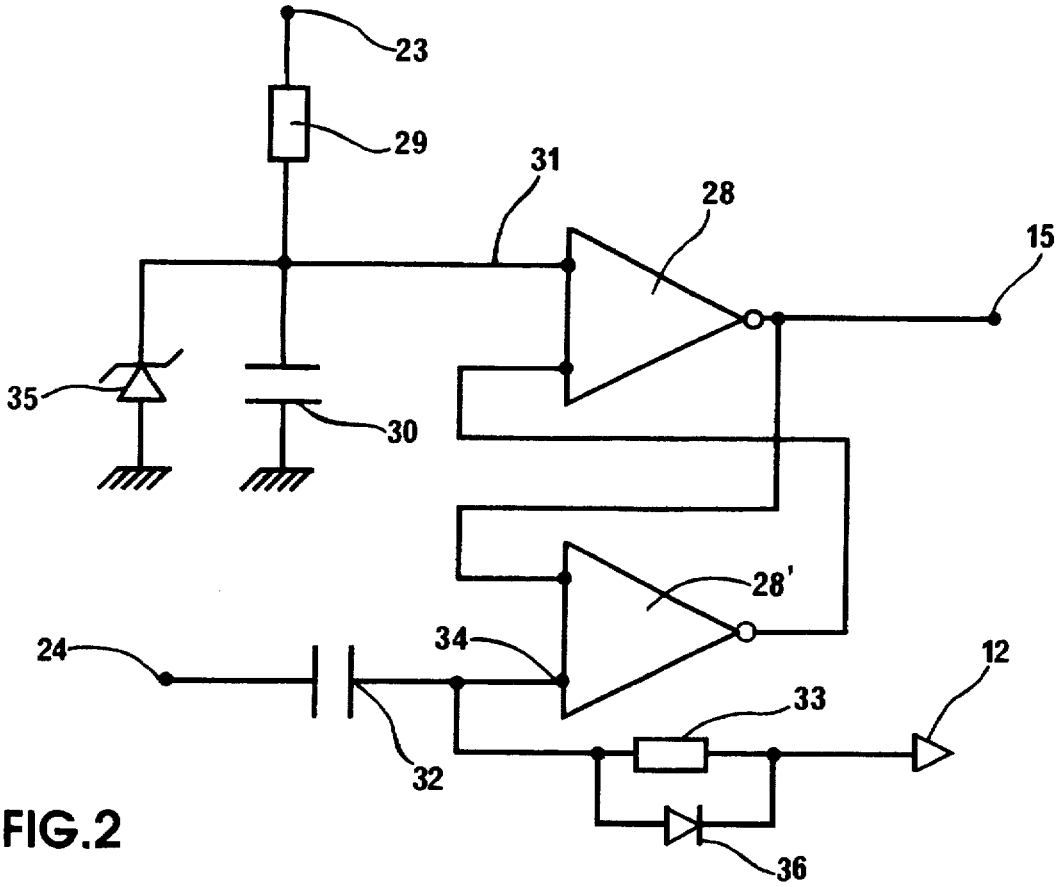
FIG. 2 represents a schematic of the preferred embodiment of the energizing synchronizer of FIG. 1.

FIG. 2 represents a preferred embodiment of the energizing synchronizer 14, constituted principally by a memory latch implemented with two NAND logic gates 28, 28'. The output voltage of the rectifying bridge 17, connected to the input 23 of the synchronizer 14, is integrated by a network comprising a resistance 29 and a capacitor 30. The existing integrated voltage at the terminals of the capacitor 30 is applied to the input 31 of a logic gate 28. The input 24 of the synchronizer 14 receives the control signal generated from the output 7 of the modulator 4. A derivator network comprising a capacitor 32 and a resistance 33 applies to the input 34 of the other logic gate 28' negative pulses synchronized at the instant of the blocking of the primary transistor 5. A Zener diode 35 and a diode 36 ensure that the inputs 31 and 34 are voltage protected. When applied with voltage, the capacitor 30 is discharged. The input 31 is at a low logic level, imposing a high logic level on the output 15 thus the conduction of the auxiliary transistor 16, thus the passage of the preheating current in the electrodes 2 and 3. When the integrated voltage on the capacitor 30 reaches the high logic level of the input 31, the negative pulse following at the input 34 engenders a change of state of the latch constituted by the two gates 28, 28'. The output 15 changes to a low logic level, blocking the transistor 16, thus keeping the circulation of the preheating current at the instant of the blocking of the primary transistor 5, ensuring thus the apparition of over-voltage at the terminals of the secondary 13 necessary for the energizing of the tube 1.

Figure 3:
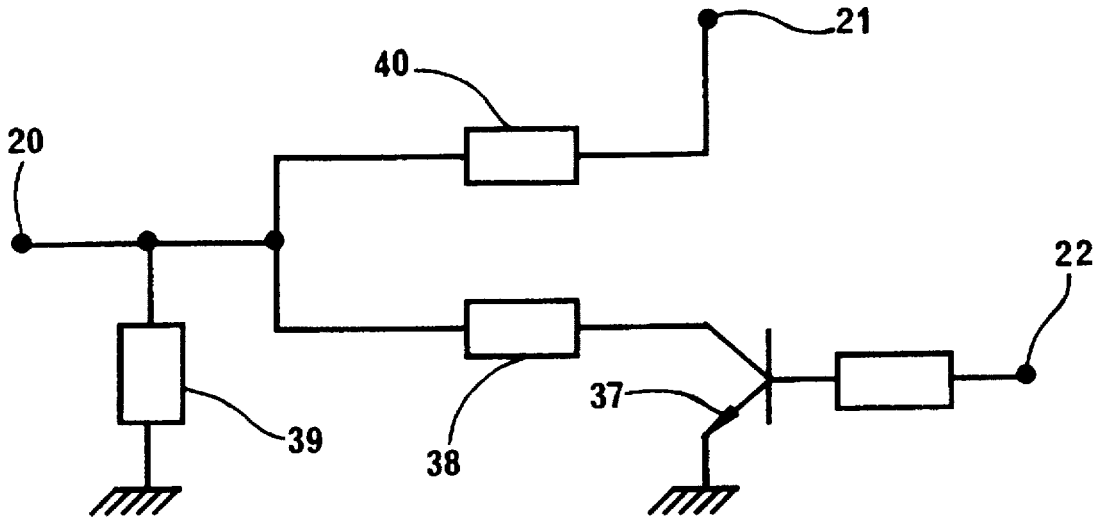
FIG. 3 represents a schematic of the preferred embodiment of the voltage divider of FIG. 1.

FIG. 3 represents a preferred embodiment of the control voltage divider 19. When the auxiliary transistor 16 conducts, its controls is generated from 15, received at the input 22, and renders conductive the transistor 37. The resistance 38 is placed in parallel across the resistor 39. The voltage divider formed by the resistance 40 and the 39, 38 assembly exhibits at its output 20 a portion of the voltage at the terminals of the measuring means 10 arriving on the input 21. When the auxiliary transistor 16 is blocked its control received by the input 22 blocks the transistor 37. The voltage divider formed by the resistance 40 and the resistance 39 exhibits then at its output 2 the quasi-totality of the voltage at the terminals of the measuring means 10 arriving at the input 21. The method allows to limit the current flowing through the transistor 5, the measuring means 10, and the primary 11 to a value greater than the nominal current, during the preheating stage.

Figure 4:
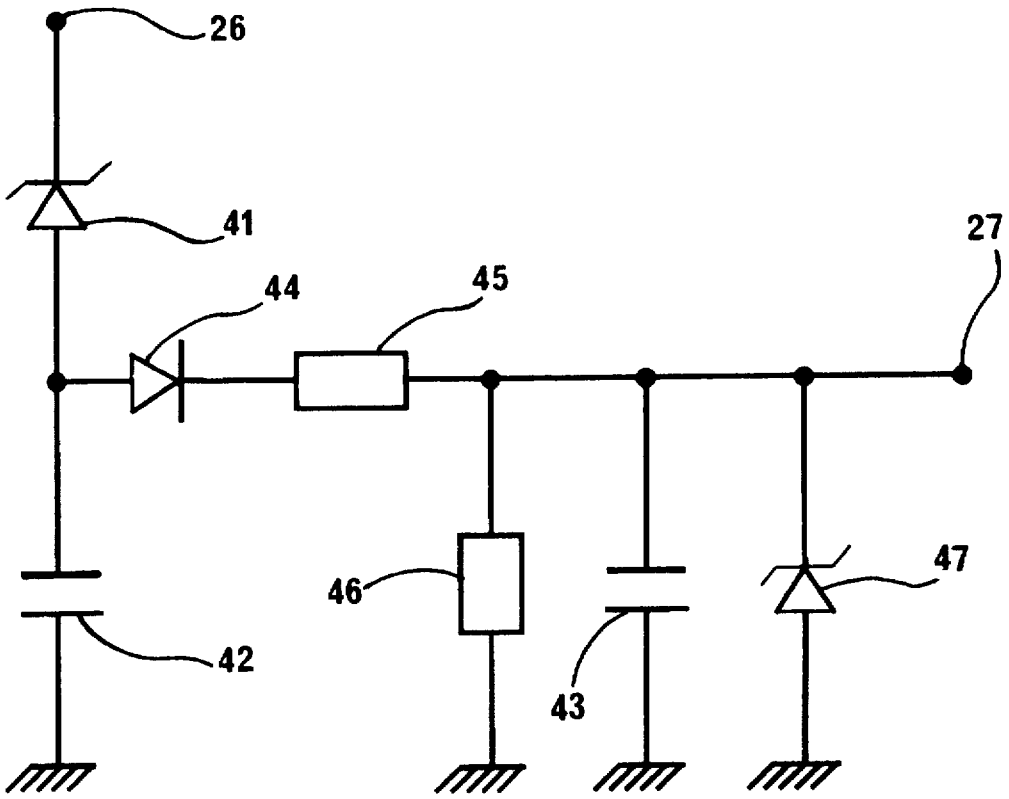
FIG. 4 represents a schematic of the preferred embodiment of the protection circuit of FIG. 1.

FIG. 4 represents a preferred embodiment of the protection circuit 25. The over-voltage at the terminals of the primary 11 arrives at the input 26 connected to the peak rectifier 41 and charges the capacitor 42. A part of the charging of the capacitor 42 is transferred to the capacitor 43 by the diode 44 and the resistance 45. When the transistor 5 conducts, the peak rectifier 41 is then directly polarized and rapidly discharges the capacitor 42. The capacitor 43 does not discharge, because the diode 44 is then inversely polarized. Upon the blockage of the transistor 5, the capacitor 43 receives a new charge and its voltage therefore progressively increases.

When it reaches the inhibition threshold of the input 9 of the modulator 4, connected at the output 27, the modulator 4 blocks itself. The capacitors 42 and 43 no longer receive any charge, and to the contrary, slowly discharge themselves into the high-valued resistance 46. When the disinhibition threshold of the input 9 is reached, the modulator restarts and the cycle is resumed or the tube 1 is energized. A Zener diode 47 limits the voltage on the output 27.

According to the invention, apart from the tube 1 and the transformer 6, the control device assembly is advantageously implemented either in hybrid technology, or in the form of an integrated electronic circuit.

I claim:

1. Device to control a fluorescent tube, supplied with power from a DC source via an accumulating converter comprising a transformer, whose primary is in series with a primary transistor, controlled by a pulse magnitude modulator, and a current measuring means, and whose secondary is connected to the fluorescent tube, said device further comprising:

a rectifying bridge, mounted opposite to the secondary, between preheating electrodes of the tube;

an auxiliary transistor connected to the rectifying bridge, and an energizing synchronizer connected to the rectifying bridge, receiving at one input the control signal of the primary transistor via the modulator, and controlling the auxiliary transistor 16 via an output, in such a manner that the blocking of the auxiliary transistor is controlled by the energizing synchronizer in synchronism with the blocking of the primary transistor by the modulator.

2. Device according to claim 1, characterized in that the synchronizer comprises a latch whose one input is controlled by an integrator of the output voltage of the rectifying bridge, and whose other input is controlled by a derivator, of the blocking signal of the primary transistor from the modulator, in such a manner as to control by the integrator the preheating time of the tube, and to control by the derivator the changing of the state of the latch and the blocking of the auxiliary transistor.

3. Device according to claim 1, characterized in that it additionally comprises a voltage divider supplied with the voltage at the terminals of a measuring means, receiving from the synchronizer the control signal of the auxiliary transistor, and applying to the modulator a low voltage signal during the conduction duration of the auxiliary transistor corresponding to the preheating time of the tube, and a high voltage signal when the auxiliary transistor is blocked.

4. Device according to claim 3, characterized in that the voltage divider is constituted by a first resistance in series with two resistances in parallel one of which is in series with a transistor controlled by the control signal of the auxiliary transistor, in such a manner that, when the controlled transistor conducts, an output node of the voltage divider delivers a low voltage, and when the controlled transistor is blocked, said output node of the voltage divider delivers a high voltage.

5. Device according to claim 1, further comprising a protection circuit supplied with voltage from a node between the primary transistor and the primary of the transformer and delivering to the modulator an inhibition signal in such a manner as to block the modulator during a predetermined time in case of malfunction of the tube.

6. Device according to claim 5, characterized in that the protection circuit comprises a first capacitor susceptible to being progressively charged at each blockage of the primary transistor until it reaches an inhibition threshold of the modulator, and in that it slowly discharges in a first resistance until it reaches the disinhibition threshold of the modulator.

7. Device according to claim 6, characterized in that the protection circuit comprises a peak rectifier and a second capacitor, whose intermediate node is connected to said first capacitor by a diode and a second resistance in such a manner as to ensure the progressive charging of said first capacitor while at the same time keeping it from discharging through the peak rectifier.

8. Device according to one of the claims 1 through 7, characterized in that apart from the tube and the transformer, the control device assembly is implemented in hybrid technology.

9. Device according to one of the claims 1 through 7, characterized in that apart from the tube and the transformer the control device assembly is implemented in the form of an electronic integrated circuit.

* * * * *